United States Patent [19]

Wright

[11] Patent Number: 4,664,244

[45] Date of Patent: May 12, 1987

[54] MOVING COIN VALIDATION

[75] Inventor: John Wright, Bournemouth, England

[73] Assignee: Aeronautical & General Instruments PLC, Croydon, England

[21] Appl. No.: 854,956

[22] Filed: Apr. 22, 1986

[30] Foreign Application Priority Data

Apr. 22, 1985 [GB] United Kingdom ..... 8510181

[51] Int. Cl.[4] ..... G07D 5/08

[52] U.S. Cl. ..... 194/317

[58] Field of Search ..... 194/317, 318, 319

[56] References Cited

U.S. PATENT DOCUMENTS 4,124,111 11/1978 Hayashi ..... 194/319 X
4,234,071 11/1980 Le-Hong ..... 194/317
4,361,218 11/1982 Van Dort ..... 194/317
4,460,080 7/1984 Howard ..... 194/317
4,538,719 9/1985 Gray et al. ..... 194/317

*Primary Examiner*—F. J. Bartuska
*Attorney, Agent, or Firm*—Sughrue, Mion, Zinn, Macpeak and Seas

[57] ABSTRACT

A method and apparatus for validating a moving coin by detecting an oscillating signal generated in coils connected in a tuned oscillating circuit. A property of the signal which varies linearly with coin displacement in one direction for a first period and varies linearly in an opposite direction with coin displacement for a second period is measured. From measurements made during the first and second periods a signal characteristic of the coin, and substantially independent of the coin's velocity is derived. The coin is validated by comparing this signal with stored reference values.

13 Claims, 4 Drawing Figures

COIN VALIDATOR CIRCUIT
IC6 ICM75-55,IPA
IC7 ICL7611-DCPA
IC4 CA 3046
BC184
R14 100K
R23 33K
R20 10K
R21 6K
R22 22K
C8 1000p
C7 4µ7
R19 4K7
R12 12K
R5 4K7
R15 47K
R11 47K
R17 2K2
33K
R10 220
C2 10n
C5 0·1µ
R8 12K
R7 12K
R9 12K
L1
L2

MOVING COIN VALIDATION

The invention relates to methods and apparatus for validating moving coins.

Coin validation apparatus may be self contained or may be associated with a coin freed mechanism or a variety of coin receiving machines such as coin box telephones or vending machines or it may form part of a coin sorting apparatus to check that coins are valid and not counterfeit.

Several conventional coin validation methods carry out tests on a coin when it is stationary at a fixed reference point relative to the remainder of the validation apparatus. An example of such apparatus is illustrated in our earlier patent application No. EP-A-0062411. One of the disadvantages of these static systems is that the time taken to validate a number of coins can be long since each coin must be brought to rest, validated, and then urged in an appropriate direction depending on the results of the validation.

In view of this, there have been some proposals for validating moving coins. Clearly, if suitable methods can be devised this will increase considerably the processing speed over the static systems. However, the previous proposals have involved complex electronics to deal with the elimination of the effects of coin velocity which is a largely uncontrollable variable in the coin validation system.

In accordance with one aspect of the present invention, a method of validating a coin by monitoring an oscillating signal generated by an electrical coil connected in a tuned oscillating circuit in the presence of the coin, deriving from the oscillating signal a measurement representative of the coin, and comparing each measurement with a reference value to determine whether the coin is valid, is characterized in that the coin is moved past the coil, and in that the monitoring is carried out for a first fixed time period during which the oscillating signal is varying linearly in one direction as the coin approaches the coil to derive a first measurement, and for a second fixed time period during which the oscillating signal is varying linearly in the opposite direction as the coin moves away from the coil to derive a second measurement, the first and second measurements being combined substantially to cancel out the effect of the coin's velocity and to derive the measurement representative of the coin.

This invention makes use of the facts that firstly although coin velocities may vary from coin to coin, in general any individual coin moves at a substantially constant velocity along a coin runway, and secondly as a coin approaches the electrical coin it has a linearly increasing effect on the oscillating signal generated by the oscillator circuit until a saturation effect is reached and subsequently, as the coin leaves the vicinity of the electrical coil, the coin has a linearly decreasing effect. If the velocity is substantially constant throughout the coin's passage past the electrical coil these increasing and decreasing effects will be equal and opposite. Typically the coil has an area of influence of similar area to that of the coin, even if some acceleration occurs this will in general result in very little difference in velocity between that of the coin approaching the coil and it leaving. Accordingly even in this case there will be only an insignificant effect on the measurements as long as the velocity change during the coin's passage through the coils is not large in comparison with the mean velocity. Thus, by summing the two measurements a resultant measurement, effectively a mean measurement, is obtained which is substantially independent of the velocity of the coin.

A typical property of the oscillating signal which may be monitored is the frequency of the oscillating signal which varies in accordance with changes in the inductance of the coil caused by the coin. This change in inductance is related to the coin diameter and thus represents a method by which the coin diameter can be detected. As a coin enters the vicinity of the electrical coil and the magnetic field generated by the electrical coil, the frequency of the oscillating signal generated by the oscillating circuit gradually increases. The number of cycles of the oscillating signal are then counted for a fixed time period while the frequency is increasing and the number of cycles is also counted for the same fixed time period while the frequency is decreasing as the coin leaves the vicinity of the electrical coil. If, another similar coin with a higher velocity passes the electrical coil, then during the first fixed time period there is a greater number of cycles of the oscillating signal since the coin travels a greater distance and so has a greater influence on the coil than the first coin. During the second fixed time period, however, there is a smaller number of cycles since the coin passes out of the vicinity of the coil more quickly. The total number of cycles in both fixed time periods are, however, substantially the same for both coins.

Preferably, the method further comprises sensing a trailing edge of the coin at a first position and thereupon causing the first fixed time period to commence; and sensing a leading edge of the coin at a second position position and thereupon causing the second fixed time period to commence.

Alternatively the method further comprises sensing the velocity of the coin and calculating from the sensed velocity the time of commencement of the first and second of the fixed time periods.

The total time during which a coin is causing a linearly changing effect in the oscillating signal varies with coins of different demonination and so conveniently and fixed time period is chosen to be short enough so that a plurality of coins of different denomination may be validated.

Preferably, more than one property of the oscillating signal is monitored to increase the accuracy of the validation. For example, in addition to monitoring the frequency of the oscillating signal, the amplitude of the signal can be monitored. The amplitude will change due to the induction of eddy currents in the coin causing loss effects. Conveniently, this change in amplitude is represented by a parameter signal whose frequency is proportional to the change in amplitude and thus this frequency can be monitored during the fixed time periods in a way similar to that described above in connection with monitoring the frequency of the oscillating signal itself.

According to a second aspect of the present invention a coin validation apparatus including a coin runway; an electrical coin adjacent the coin runway; a tuned feedback oscillator circuit having the electrical coil, in its feedback loop; oscillating signal monitoring means for monitoring the oscillating signal generated by the oscillator circuit and deriving a measurement representative of a coin; and validator means for comparing a measurement representative of the coin with a stored reference value, is characterized in that the apparatus includes timing means to enable the oscillating signal monitoring means to monitor the oscillating signal for a first fixed time period during which the oscillating signal is varying linearly in one direction as the coin approaches the coil to derive a first measurement and for a second fixed time period during which the oscillating signal is varying linearly in the opposite direction to derive a second measurement, and in that the apparatus further includes means to combine the first and second measurements substantially to cancel out the effect of the coin's velocity and to derive the measurement representative of the coin.

The timing means, oscillating signal monitoring means, means to combine the measurements, and validator means may conveniently be provided by a suitably programmed microcomputer or microprocessor and associated sensors.

Preferably the timing means include a first and second sensors, the sensors being arranged to produce signals to initiate the first and second fixed time periods. It is especially preferred that the first sensor is positioned upstream of the second sensor and is arranged to initiate the first fixed time period upon sensing a trailing edge of the coin and that the second sensor is arranged to initiate the second fixed time period upon sensing a leading edge of the coin.

An example of a method and apparatus in accordance with the invention will now be described with reference to the accompanying drawings, in which.

Figure 1:
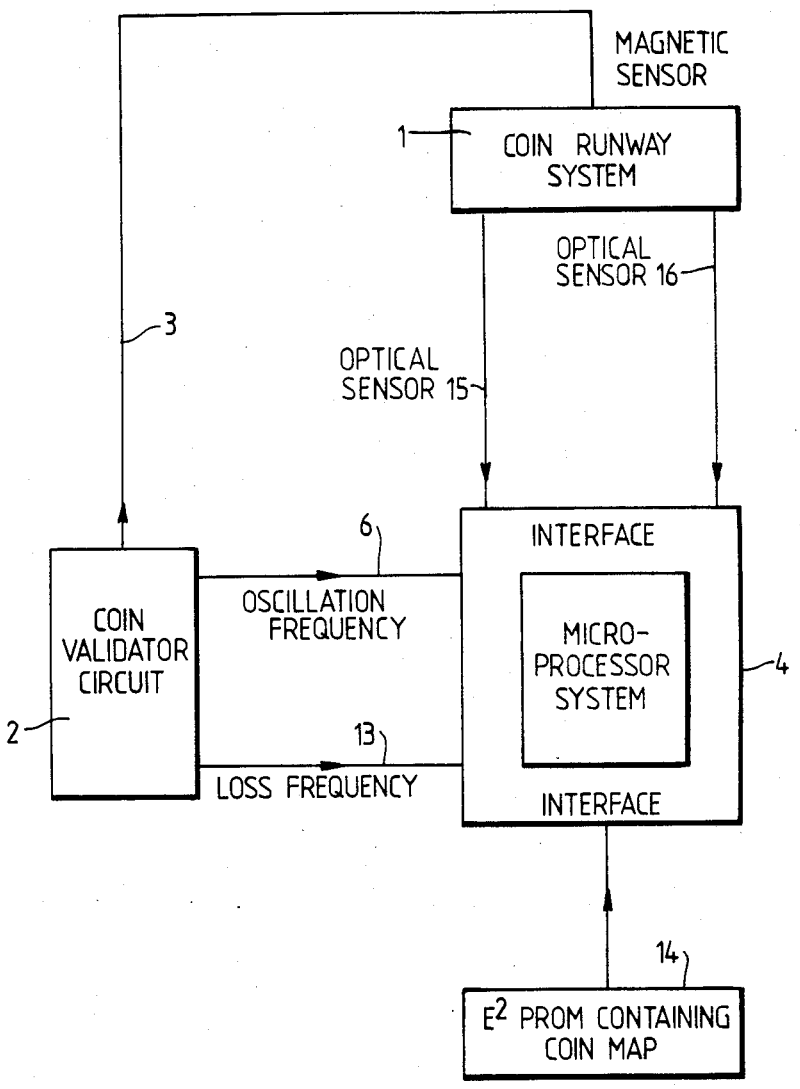
FIG. 1 is a block diagram of the apparatus.

The apparatus shown in block diagram form in FIG. 1 may be self contained or may be incorporated into a larger system such as a pay telephone. The apparatus includes a coin runway system 1 of conventional form having a coin entry slot and a runway along which a coin passes having been fed through the slot at an input end of the runway. The runway may include a damper to prevent the coin bouncing as it moves along. A pair of coils $L_1$, $L_2$ (FIG. 2) connected in series are positioned on either side of the runway 1 and are connected with the remainder of a coin validator circuit 2 by a pair of lines 3. In addition, two optical sensors (not shown) are positioned to detect the passage of a coin along the runway, output signals from the sensors being fed to a microcomputer or microprocessor system 4. Each optical sensor may comprise a light emitting diode positioned on one side of the runway and a photodetector positioned on the other side.

Figure 2:
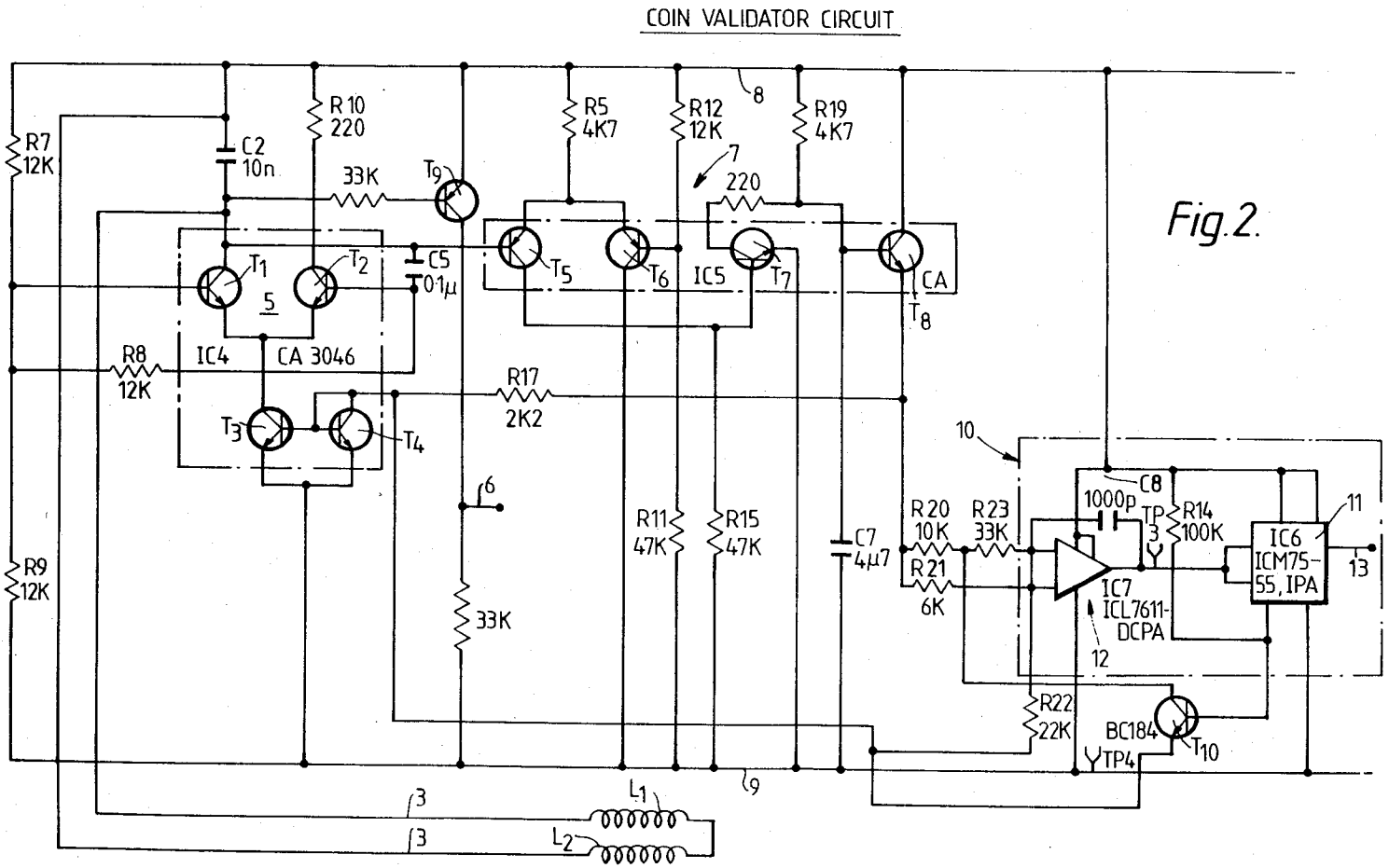
FIG. 2 is a circuit diagram of the coin validator circuit shown in FIG. 1; and, FIGS. 3 and 4 illustrate the effect of large and small coins respectively on the oscillating signal generated by the FIG. 2 circuit.

The coin validator circuit 2 is shown in more detail in FIG. 2. The circuit comprises a tuned oscillator circuit formed by the coils $L_1$, $L_2$, a tuning capacitor C2 and an acitve component 5 formed by a longtail transistor pair $T_1$, $T_2$. The tuned circuit oscillates at a frequency given by:

$$1/2\pi\sqrt{(LC)}$$

where

L is the inductance of the pair of coils $L_1$, $L_2$, and

C is the capacitance of the tuning capacitor C2.

The amplitude of the oscillating signal generated by the oscillator is controlled by a current mirror configuration of a pair of transistors $T_3$, $T_4$. The transistors $T_1$–$T_4$ are all provided in an integrated circuit known by the model number CA3046.

The oscillating signal is also applied to the base of a transistor $T_9$ which acts to "square up" the signal which is then output as a first parameter signal on a line 6 to the microcomputer 4.

The coin validation circuit also includes an amplitude monitoring circuit 7 comprising transistors $T_5$–$T_8$. These transistors are formed in an integrated circuit known by the model number CA3096. The oscillating signal from the oscillator circuit is fed to the base of the transistor $T_5$ while the base of the transistor $T_6$ is fed with a proportion of a constant voltage applied between the lines 8,9 as determined by the resistors R11, R12. If no oscillating signal is applied to $T_5$ then $T_6$ will be fully on while $T_5$ will be off. During an increase in the oscillating signal, $T_5$ will turn on during the negative half-cycle and thus $T_7$ will start to switch on which causes a negative pulse to be applied to the base of transistor $T_8$. The output from the transistor $T_8$ causes a control voltage to be applied to the junction between a resistor R17 and a resistor R20 to control operation of the current mirror transistor configuration $T_3$, $T_4$. Thus, if an increase in the losses in the oscillator circuit occurs this will cause an increase in the voltage applied to the resistor R17 and hence an increase in the collector current of the transistor $T_4$. This is mirrored by an increase in the current fed to the oscillating circuit by transistor $T_3$. This will maintain the amplitude of the oscillating signal.

The control signal represented by the voltage developed over the resistor R17 is also applied to a voltage to frequency converter 10. The converter 10 comprises a timer 11 formed by an integral circuit Model No. ICM7555 and a ramp generator 12 formed by an integrated circuit Model No. ICL7611. The ramp signal from the generator 12 is fed to two reference inputs of the timer 11 while the voltage signal generated across the resistor R17 is fed to the input of the ramp generator 12. The output of the timer 11 is a signal whose frequency is proportional to the magnitude of the voltage developed across the resistor R17. An output signal from pin 7 of the timer 11 applied to the transistor $T_{10}$ causes periodic changes in direction of the ramp signal. This signal is fed as a second parameter signal along a line 13 to the microcomputer 4.

In use, a coin runs along the coin runway 1 which is so designed to remove some of the coin entry energy using a ceramic insert in a conventional manner so as to reduce bouncing but which also ensures that the coin does not come to rest. The microcomputer 4 is suitably programmed to determine from the output of a leading optical sensor 15 when a leading edge of the coin has been sensed by the sensor ($t_1$). The microcomputer then senses the time ($t_2$) when a trailing edge of the coin leaves the sensor and starts to monitor output signals from the coin validation circuit 2. When the coin has entered the magnetic field generated between the coils $L_1$, $L_2$ the combined inductance L of this magnetic circuit will change in accordance with the equation:

$$L=L_1+L_2+2K\sqrt{(L_1\times L_2)}$$

The coefficient of coupling (K) between the two coils will be reduced thus reducing the total inductance L of the series connection. This will result in a change in the oscillating frequency of the oscillator circuit. This oscillating frequency, as previously described, is fed along the line 6 to the microcomputer 4.

In addition, due to eddy currents induced in the coin additional losses are introduced causing a change in the amplitude of the oscillating signal. This change in amplitude is monitored by the monitor 7 and an appropriate control signal voltage is applied to the transistor pair $T_3$, $T_4$ to return the amplitude to its original magnitude. This control signal is converted by the converter 10 to a signal whose frequency is directly proportional to the control signal magnitude and which is fed along the line 13 to the microcomputer 4. The frequency of this signal will be proportional to 1/Q or 1/R where R is a resistive component in parallel with the tuned circuit.

The signal on the line 6 thus represents the coin diameter while the signal on the line 13 represents coin resistivity and thickness.

Figure 3:
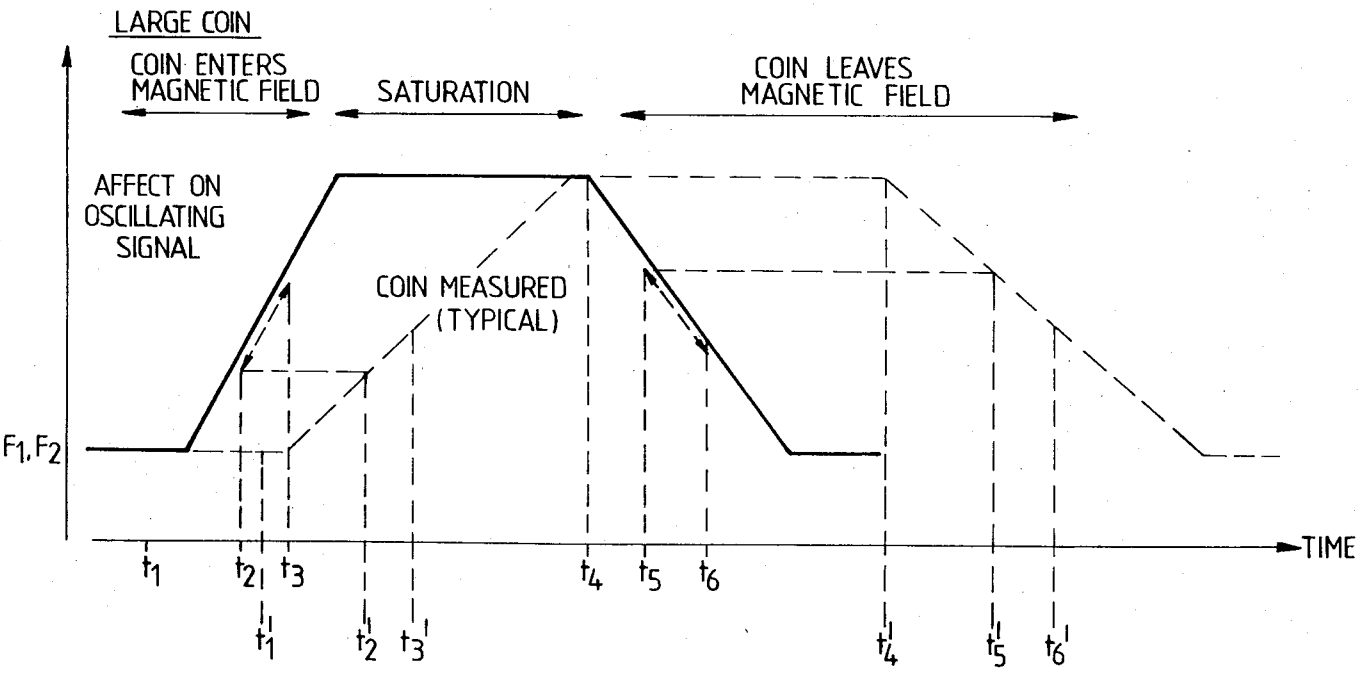

FIG. 3 illustrates the effect of a coin on the two properties of the oscillating signal which are monitored. The form of the effect is the same although the magnitude may differ. Conveniently, the graph shown in FIG. 3 may be taken to represent changes in the first and second parameter signals. Thus, before the coin enters the magnetic field generated by the coils $L_1$, $L_2$ the two parameter signals have respectively small frequencies $F_1$, $F_2$ respectively. The leading optical sensor 15 senses a leading edge of the incoming coin at a time $t_1$ and the microcomputer determines the presence of the coin. Shortly afterwards the frequencies of the parameter signals begin to increase in a linear fashion (but not necessarily with the same slope). The microcomputer 4 starts to monitor the parameter signals at a time $t_2$ when a trailing edge of the coin is sensed by the sensor. This monitoring period is for a fixed time period and expires at $t_3$ at a time when the frequencies of both parameter signals are still linearly increasing. The duration of this fixed time period is less than $1\times10^{-2}$ secs.

As the coin continues to enter the magnetic field the effect on the oscillating signal will continue to increase until the coin fully screens the magnetic flux path at which point saturation is reached. A second sensor 16 is positioned to detect the leading edge of the coin downstream of the leading sensor at a time $t_5$ which is after $t_4$ when the effect of the coin on the field starts to decrease. The microcomputer 4 then monitors the first and second parameter signals for the same fixed time period $t_3-t_2$ until a time $t_6$ during which the frequencies of the parameter signals are linearly decreasing at the same rate as they increased in the time interval between $t_2$ and $t_3$.

During the monitoring periods, the microcomputer calculates the number of pulses that have occurred in each parameter signal. These two measurements are then summed by the microcomputer to determine two resultant measurements corresponding to the two parameter signals.

The microcomputer 4 is connected to an $E^2$PROM device 14 in which are stored upper and lower acceptance limits for the two measurements for valid coins. The microcomputer 4 thus compares the resultant measurements with the stored upper and lower limits and if both resultant measurements fall within respective limits relating to a valid coin, the microcomputer 4 will determine that the coin is valid. If an invalid coin is detected the microcomputer 4 can generate an appropriate signal to cause the coin to be directed to a reject position and/or to cause a suitable message to be displayed.

If the same coin was passed along the runway at a lower velocity the effect on the oscillating signal would take the form shown by the dashed line in FIG. 3. Thus, since the coin is moving more slowly the slope of the linear portions is more shallow. Once again, the leading optical sensor 15 will determine the times $t_1$, $t_2$ and hence the microcomputer will determine the time $t_3$. The shallow slope means that the number of pulses counted by the microcomputer during the monitoring period $t_2-t_3$ will be less than previously. The saturation period will be longer in view of the slower moving coin so that the second optical sensor 16 will determine a time $t_5'$ much later than the time $t_5$. However, from this time the microcomputer 4 will determine, as before, the time $t_6'$ so that the time interval $t_5'-t_6'$ is the same as that between $t_5$ and $t_6$. In view of the different slope, however, the number of pulses of the parameters signals counted will be greater than previously. Thus, when the two pulse measurements for each parameter signal are summed the resultant will be the same as in the previous case with the faster moving coin and thus the effect of velocity has been removed.

Figure 4:
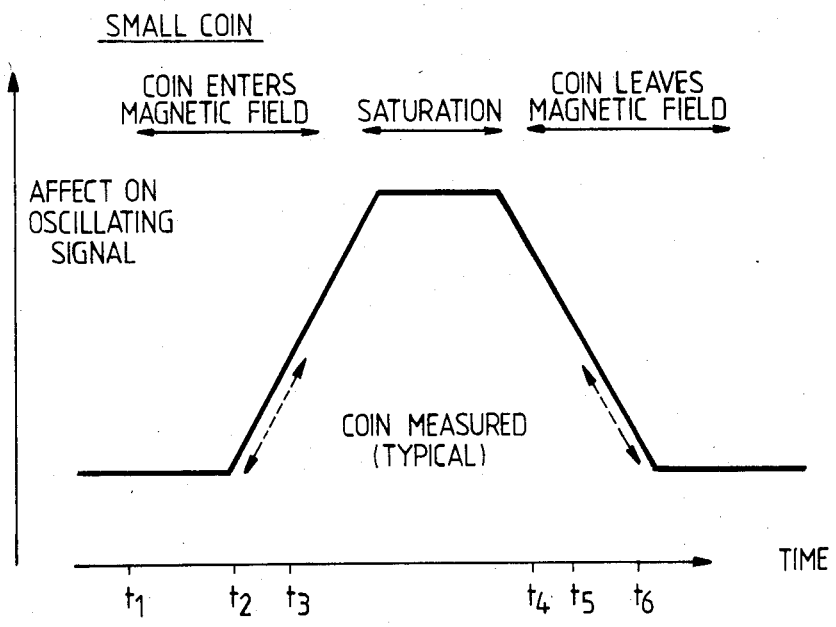

FIG. 4 illustrates the difference in the effect in the oscillating signal when a smaller coin passes the coils $L_1$, $L_2$. It will be seen that the linear effect commences at a later time after the leading edge of coin has been detected by the optical sensor so that the time interval between $t_1$ and $t_2$ must be chosen to be large enough so that the smallest coins can be validated but small enough so that $t_3$ is reached before saturation. Similarly the time interval between $t_4$ and $t_5$ must be appropriately chosen so that the time $t_6$ is reached before the coin no longer effects the magnetic field.

I claim:

1. In a method of validating a coin including the steps of:

monitoring an oscillating signal generated by an electrical coil connected in a tuned oscillating circuit in the presence of said coin;

deriving from said oscillating signal a measurement representative of said coin; and, comparing each said measurement with a reference value to determine whether said coin is valid, the improvement wherein said coin is moved past said coil, wherein said monitoring step is carried out in a first and a second fixed time period, during said first fixed time period said oscillating signal varying linearly in one direction as said coin approaches said coil and said monitoring step deriving a first measurement, during said second fixed time period said oscillating signal varying linearly in a direction opposite said one direction as said coin moves away from said coil and said monitoring step deriving a second measurement;

and wherein said first and second measurements are combined substantially to cancel out the effect of said coin's velocity to derive said measurement representative of said coin.

2. The method of claim 1, further comprising the step of:

sensing a trailing edge of said coin at a first position and thereupon causing commencement of said first fixed time period; and, subsequently sensing a leading edge of said coin at a second position and thereupon causing commencement of said second fixed time period.

3. The method of claim 1, further comprising the steps of:

sensing velocity of said coin; and, calculating from said sensed velocity commencement of said first and second time periods.

4. The method of claim 1, wherein said monitoring of said oscillating signal includes counting the number of oscillating signal periods occurring during each of said first and second fixed time periods.

5. The method of claim 1, wherein said monitoring of said oscillating signal includes sensing amplitude of the said signal.

6. The method of claim 5, wherein said oscillating signal amplitude is represented by a parameter signal the frequency of which is proportional to a change in amplitude of said oscillating signal, and said first and second measurements are derived by counting the number of parameter signal periods occurring during each of said first and second fixed time periods.

7. The method of claim 1, wherein said monitoring of said oscillating signal includes sensing at least two properties of the said signal.

8. The method of claim 1, wherein said first and second time periods are equal.

9. The method of claim 8, wherein said first and second fixed time periods are short enough for coins of more than one differentl denomination to be validated.

10. The method of claim 9, wherein said first and second fixed time periods are short enough to enable all of the different denominations of coin in a particular currency to be validated.

11. A coin validation apparatus including:

a coin runway having an upstream end and a downstream end;

an electrical coil adjacent said coin runway and intermediate said ends;

a tuned feedback oscillator circuit having said electrical coil in said feedback loop;

oscillating signal monitoring means for monitoring an oscillating signal generated by said tuned feedback oscillator circuit and deriving a measurement representative of a coin;

storage means for storing a reference valve representative of a valid coin;

validator means for comparing a measurement representative of said coin with said stored reference value;

timing means for establishing a first and second fixed time period and arranged to enable oscillating signal monitoring means to monitor said oscillating signal for said first fixed time period during which said oscillating signal is varying linearly in one direction as said coin approaches said coil to derive a first measurement and for said second fixed time period during which said oscillating signal is varying linearly in a direction opposite said one direction to derive a second measurement; and, combining means to combine said first and second measurements substantially to cancel out effects of said coin's velocity and to derive said measurement representative of said coin.

12. The apparatus of claim 11, wherein said timing means include first and second sensors, said sensors being arranged to produce signals to initiate said first and second fixed time periods.

13. The apparatus of claim 14, wherein said first sensor is positioned upstream of said second sensor and wherein said first sensor is arranged to initiate said first fixed time period upon sensing a trailing edge of said coin and said second sensor is arranged to initiate said second fixed time period upon sensing a leading edge of said coin.

* * * * *